US007944407B2

(12) United States Patent
Kojima et al.

(10) Patent No.: US 7,944,407 B2
(45) Date of Patent: May 17, 2011

(54) DISPLAY APPARATUS

(75) Inventors: Ayahito Kojima, Kawasaki (JP); Shigeki Kameyama, Kawasaki (JP); Hirohito Kuriyama, Kawasaki (JP); Yoshikazu Kanazawa, Kawasaki (JP); Toshio Ueda, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 1158 days.

(21) Appl. No.: 11/202,061

(22) Filed: Aug. 12, 2005

(65) Prior Publication Data

US 2005/0264489 A1 Dec. 1, 2005

Related U.S. Application Data

(63) Continuation of application No. 09/929,049, filed on Aug. 15, 2001, now abandoned.

(30) Foreign Application Priority Data

Sep. 25, 2000 (JP) ..... 2000-290981

(51) Int. Cl.
*G09G 3/28* (2006.01)

(52) U.S. Cl. ..... 345/63; 345/60

(58) Field of Classification Search ..... 345/55, 345/60, 63, 589–605
See application file for complete search history.

(56) References Cited

U.S. PATENT DOCUMENTS 5,956,014 A 9/1999 Kuriyama et al.
6,072,448 A * 6/2000 Kojima et al. ..... 345/63
6,081,254 A * 6/2000 Tanaka et al. ..... 382/167
6,373,702 B2 * 4/2002 Oishi et al. ..... 361/704
6,597,333 B2 * 7/2003 Todoroki et al. ..... 345/63

FOREIGN PATENT DOCUMENTS

| | | | |
|---|---|---|---|
| EP | 0841652 | A1 | 5/1998 |
| EP | 0845769 | A1 | 6/1998 |
| EP | 0945845 | A2 | 9/1999 |
| EP | 0965 974 | A1 | 12/1999 |
| JP | 8-63124 | | 3/1996 |
| JP | 8-248819 | | 9/1996 |
| JP | 10-207423 | | 8/1998 |
| JP | 10-214059 | | 8/1998 |
| JP | 10-232647 | | 9/1998 |
| JP | 2000-10522 | | 1/2000 |
| JP | 2001-134197 | | 5/2001 |
| WO | 00/17845 | | 3/2000 |

OTHER PUBLICATIONS

Non-Final Office Action mailed Mar. 11, 2005; U.S. Appl. No. 09/929,049.
Final Office Action mailed Jul. 26, 2004; U.S. Appl. No. 09/929,049.
Non-Final Office Action mailed Feb. 11, 2004; U.S. Appl. No. 09/929,049.
European Search Report, dated Mar. 3, 2006, for related European Patent Application No. EP 01 30 7211.

* cited by examiner

*Primary Examiner* — Srilakshmi K Kumar
(74) *Attorney, Agent, or Firm* — Staas & Hasley LLP

(57) ABSTRACT

A display apparatus, that can prevent thermal destruction and burning with a simple structure, has been disclosed. In the apparatus it is judged that there is possibility of a pattern, whose area with high brightness is small, being displayed frequently, when a state in which the total light emission pulse number remains large occurs with high frequency, and if such a state is detected, the total light emission pulse number (sustain frequency) is reduced to prevent the thermal destruction and burning.

8 Claims, 20 Drawing Sheets

| TOTAL NUMBER | SF0 | SF1 | SF2 | SF3 | SF4 | SF5 |
|---|---|---|---|---|---|---|
| 63 | 1 | 2 | 4 | 8 | 16 | 32 |
| 127 | 2 | 4 | 8 | 16 | 32 | 64 |
| 255 | 4 | 8 | 16 | 32 | 64 | 128 |
| 511 | 8 | 16 | 32 | 64 | 128 | 256 |

DISPLAY APPARATUS

CROSS-REFERENCE TO RELATED APPLICATIONS

This application is a Continuation of application Ser. No. 09/929,049, filed Aug. 15, 2001, now abandoned, and claims the benefit of Japanese Application No. 2000-290981 filed Sep. 25, 2000.

BACKGROUND OF THE INVENTION

The present invention relates to a display apparatus such as a plasma display (PDP) apparatus. More particularly, the present invention relates to a display apparatus in which the display brightness is determined by the number of times of light emission and in which the number of times of light emission in each cell of the display frame of a display can be changed.

Recently, concerning a display apparatus, demand for a thinner, larger-screen, and a more definite display that can show various information and be set under various conditions are increasing, and a display apparatus that satisfies these demands is expected. There are various types for a thin display apparatus such as LCD, fluorescent display tube, EL, PDP (Plasma Display Panel), and so on. In a display apparatus such as a fluorescent, an EL, or a PDP type, gradation display is attained generally by constructing a display frame of plural subframes, varying each subframe period with a weight, and displaying each bit of the gradation data using corresponding subframes. A description is provided below using a PDP as an example. Since a PDP is widely known, a detailed description of the PDP itself is omitted here and, instead, examples of the gradation display and power control of the subframe method that relates to the present invention is described.

FIG. 1 is a block diagram that shows the general structure of a normal PDP apparatus. In a panel 10, plural X electrodes and Y electrodes are arranged adjacently by turns and plural address electrodes are arranged so as to be perpendicular to the X and Y electrodes. The plural X electrodes are connected commonly and an identical drive signal is applied by an X side common driver 11. The plural Y electrodes are connected to a Y side scan driver 12, individually, and a scanning pulse is applied sequentially in the address period. A Y side common driver 13 is connected to the Y side scan driver 12 and a common drive signal is applied to the Y electrode in the reset period and the sustain discharge period. Address electrodes are connected to an address driver 14, an address pulse is applied in synchronization with the scanning pulse in the address period, and whether the display cell of the row selected by the scanning pulse is lit or not is determined. A control panel 15 internally comprises a display data control part 16, a scan driver control part 17, and a display/power control part 18, and a vertical synchronizing signal Vsync, a dot clock and display data are supplied from outside. The control part 15 has a CPU and each above-mentioned part is realized by hardware and software run by the CPU. Address pulse data is supplied to the address driver 14 from the display data control part 16. The X side common driver 11, the Y side scan driver 12, and the Y side common driver 13 are controlled by the scan driver control part 17.

FIG. 2 is a diagram that shows the drive waveform of a subframe in the PD apparatus of so-called "address/sustain discharge period separated type•write address method." The subframe will be described later. With reference to FIG. 2, actions in the PD apparatus are described briefly. In this example, a subframe is divided into the reset period, the address period, and the sustain discharge period. In the reset period, all the cells are put into an identical state. In the address period, a scanning pulse is applied to the Y electrode sequentially and an address pulse is applied to the address electrode according to the display data (address data) in synchronization with the application of the scanning pulse. There may be the case in which an address pulse is applied to the Y electrode of a cell that is lit or the case in which an address pulse is applied to the Y electrode of a cell that is not lit. In the cell to which an address pulse is applied, an address discharge is caused to occur and wall charges are accumulated on the electrode of the cell or eliminated. This action is carried out for all the lines. All the cells are thus set to each state according to the display data of the subframe, and the wall charges required for the sustain discharge between the X electrode and the Y electrode of the lit cell are accumulated. In the sustain period, a sustaining pulse is applied to the X electrode and the Y electrode alternately, a discharge is caused to occur in the cell on which wall charges are accumulated, and the cell emits light. In this case, the brightness is determined by the length of the sustain discharge period, that is, the number of times of sustaining pulse.

In a PDP, since there exist only two values, that is, ON or OFF, the gradation is represented by the number of times of light emission. Therefore, as shown in FIG. 3, a frame corresponding to a display is divided into plural subframes and gradation display is attained by the combination of the lit subframes. The brightness of each subframe is determined by the number of the sustaining pulses. Although there may be the case in which the brightness ratio of each subframe is set to a special one in order to control the problem of the animation false contours, the structure of subframes as shown in FIG. 3, in which the brightness ratio is the power of 2, is widely used because the maximum number of gradation scales can be attained for the number of subframes in this structure. In the case of FIG. 3, The ratio of the number of sustaining pulses for the six subframes (SF) 0 through subframes 5 is 1:2:4:8:16:32, and 64 gradation scales can be represented by the combination of these, and each bit of the 6-bit display data can be corresponded to SF0 to SF5, in order. For example, if the display data of a cell is the $25^{th}$ scale (1A in the hexadecimal system), SF1, SF3, and SF4 are lit, and other SF0, SF2, and SF5 are not lit. The total of the numbers of sustaining pulses in all the subframes in a display frame is referred to as the total light emission pulse number n here. In other words, the total light emission pulse number n is equal to the number of sustaining pulses when all the subframes are lit, or the maximum number of pulses with which a cell can cause light emission during a display frame, and also called the sustain frequency.

The display data supplied from outside has, in general, a format in which the gradation data of each pixel is continuous, and cannot be changed into the subframe format as it is. Therefore, it is once stored in a frame memory provided in the display data control part 16 in FIG. 1, read out according to the subframe format, and supplied to the address driver 14. In each subframe, the action in FIG. 2 is carried out and the subframe differs from each other in the length of the sustain period (that is, the number of sustaining pulses).

When a light screen is displayed, the total number of light emission pulses in a display frame increases and the consumed power, that is, the consumed current also increases. The maximum light emission pulse number in a display frame of the whole screen is reached when all the cells are lit with the total light emission pulse number, and the display load rate is a ratio of the sum of light emission pulsed in all the cells in a display frame to the maximum light emission pulse number. The display load rate is 0% when all the cells are displayed in black, and 100% when all the cells are displayed with the maximum brightness.

In the PDP apparatus, since the current that flows during the sustain period occupies the major part, the consumed current increases if the total number of light emission pulses in a display frame increases. If the number of sustaining pulses in each subframe is fixed, that is, the total light emission pulse number n is a constant, the consumed power P (or consumed current) increases as the display load rate increases.

The limit of the consumed power is specified for the PD apparatus. It may be the case in which the total light emission pulse number n is set so that the consumed power is below the limit when the maximum display load rate is reached, that is, all the cells are displayed with the maximum brightness. The display load rate of a normal screen, however, is between 10% and tens %, and the display load rate seldom becomes near 100%, therefore, in such case, a problem in that the normal display is dark is brought forth. Because of this, a power control, in which the total light emission pulse number n is varied according to the display load rate so that a display as light as possible can be attained without the consumed power P exceeding the limit, is employed.

FIG. 4 is a diagram that shows the structure of a conventional power control part 20 realized in the control part 15, and FIG. 5 is a graph that shows the change in ratio of the total light emission pulses number n and the consumed power P to the display load rate when the control is carried out.

As shown in FIG. 4, the power control part 20 comprises a frame length operation part 21 that calculates the time of a frame (length of a frame) from the vertical synchronizing signal, a load rate operation part 22 that calculates the load rate from the display data, and a sustain frequency operation part 23 that calculates the total light emission pulse number n from the length of a frame and the load rate. As described above, the input video signal is stored in a frame memory in the display data control part 16. At this time, the signal is deployed on the display plane of the frame memory according to the subframe format, read out from each display plane according to the display subframe, and supplied to the address driver 14. The display data control part 16 counts the number of lit pixels for each subframe when storing the input video signal into the frame memory and calculates the display load rate. Therefore, the load rate operation part 22 is installed in the display data control part 16.

The power control part 20 controls as below as shown in FIG. 5: while the display load rate is below A, the total light emission pulse number n is set to n0, and when the display load rate exceeds A, the total light emission pulse number n is reduced to prevent the consumed power P from exceeding the limit. The reduced total light emission pulse number n is allocated as the sustain pulse number of each subframe according to a fixed ratio. For example, as shown in FIG. 6, if it is assumed that a display frame is composed of six SF0 to SF5 as shown in FIG. 3, that the ratio of the sustain discharge pulse numbers is 1:2:4:8:16, and that n0 is equal to 504, the ratio of sustaining pulse numbers of SF0 to SF5 when the display load rate is equal to or less than A is 8:16:62:64:128:256. When the display load rate exceeds A and the total light emission pulse number n is reduced to 252, the ratio of sustaining pulse numbers is, for example, set to 4:8:16:32:64:128. If the display load rate increases further, the numbers of sustaining pulses of each subframe SF0 to SF5 needs to be reduced further. An example case in which the ratio is kept constant is illustrated in FIG. 6, but if the number of sustaining pulses is not a whole number, it is rounded to the nearest whole number.

In the plasma display (PDP) apparatus, heat is generated by the light emission and discharge in each cell, and the amount of generated heat is in proportion to the times of light emission per unit time. Therefore, it can happen that a large amount of heat is generated locally depending on the display pattern and the thermal distribution is developed on the panel surface, resulting in a thermal destruction in an area where a large temperature gradient is caused to occur. One of the patterns that cause such a thermal destruction is, for example, a still display with high contrast. If such a pattern is displayed for a long time, the fluorescent materials, and so on, on the pattern are degraded and a phenomenon called burning occurs, even though thermal destruction may be prevented.

To solve these problems, the structure, in which the display patterns that will cause thermal destruction and burning are detected by the comparison of the image data of successive frames and the brightness is lowered in the case of such display patterns, has been disclosed in Japanese Unexamined Patent Publication (Kokai) No. 8-248819, Japanese Unexamined Patent Publication (Kokai) No. 10-207423, and Japanese Unexamined Patent Publication (Kokai) No. 2000-10522.

To detect, however, the display patterns that will cause thermal destruction and burning by comparing the display data, it is necessary to compare a large amount of image data and calculations. This process requires a calculating unit of high performance and increases the cost of the unit.

SUMMARY OF THE INVENTION

The object of the present invention is to realize a display apparatus that can prevent thermal destruction and burning with a simple structure.

As mentioned above, one of the display patterns that will cause thermal destruction and burning is a sill image with high contrast, but in the case of a display pattern in which the area with high brightness occupies a large part, the total number of times of light emission (total light emission pulse number) is reduced by the above-mentioned power control because the display load rate is large. Therefore, the amount of generated heat in each cell of the area with high brightness is reduced, the temperature gradient is not so large, and no thermal destruction or burning is caused to occur. On the contrary, in the case of a display pattern in which the area with high brightness is small, the display load rate is small, but the total light emission pulse number remains still large as before. Therefore, the amount of generated heat in each cell of the area with high brightness is large, the temperature gradient is large, and thermal destruction and burning may occur.

The present applicants have developed the present invention taking this point into consideration. In other words, according to the present invention, when a state in which the total light emission pulse number remains large is repeated with a high frequency, it is judged that there is possibility of a pattern of a small area with high brightness being displayed frequently, and the total light emission pulse number (sustain frequency) is reduced to prevent a thermal destruction and burning if such a state is detected.

Needless to say, in the case of a pattern in which the area with high brightness is small but the area moves, or a totally and uniformly dark pattern, thermal destruction or burning does not occur even though a state in which the total light emission pulse number remains large is repeated with high frequency. The total light emission pulse number is reduced for such a pattern, but this will bring forth no problem in the display.

Moreover, when a state in which the total light emission pulse number remains large is repeated with high frequency, the total light emission pulse number is reduced, but when such a state is terminated, that is, when a state in which the total light emission pulse number remains lower than a fixed value is repeated with high frequency, the total light emission pulse number is controlled so as to increase.

A state in which the total light emission pulse number remains large and a state in which it remains small are defined as, for example, when the first state in which the total light emission pulse number remains over the fixed first threshold value lasts longer than the fixed sustain period, and when the second state in which the total light emission pulse number remains below the fixed second threshold value lasts longer than the fixed suppress period, respectively. Another example of the definition is that when the cumulative time of the first state in the fixed cumulative period is more than the first fixed value, and when the cumulative time of the second state in the fixed cumulative period is more than the second fixed value.

In addition to the above-mentioned criteria for evaluation, it is possible to include the criteria for evaluation of the gradation scale and control so that the total light emission pulse number is reduced only when a state in which the gradation scale calculated from the display data is over the fixed scale lasts longer than the fixed sustain period. This will enable the judgment of the proportion of the light area, and the total light emission pulse number can be prevented from decreasing when the display is dark.

When the above-mentioned cumulative time is judged, it is recommended to detect whether the first state and the second state are repeated or not from the cumulative times of the first state and the second state, and to change the first fixed value and the second fixed value if the repeat is detected.

Moreover, it is advisable to change the first fixed value and the second fixed value according to the elapsed time from the turn-on of the unit because there exist a considerable difference in averaged panel temperature between at the turn-on and after a fixed time is elapsed.

In addition, when a cooling fan to cool the panel is provided, it is effective to start or accelerate the cooling fan when the first state in which the total light emission pulse number remains large appears with high frequency, and to stop or decelerate the cooling fan when the second state in which the total light emission pulse number remains below a fixed value appears with high frequency.

BRIEF DESCRIPTION OF THE DRAWINGS

The present invention will be more clearly understood from the description as set below, with reference to the accompanying drawings, wherein.

DESCRIPTION OF THE PREFERRED EMBODIMENTS

The embodiments in which the present invention is applied to the plasma display (PDP) apparatus are described below. The present invention is not restricted to these, but can be applied to any display apparatus as long as the display brightness is determined by the number of times of light emission, and the total number of times of light emission in each cell of the display frame of a screen can be changed according to the power consumed in the apparatus.

Figure 1:
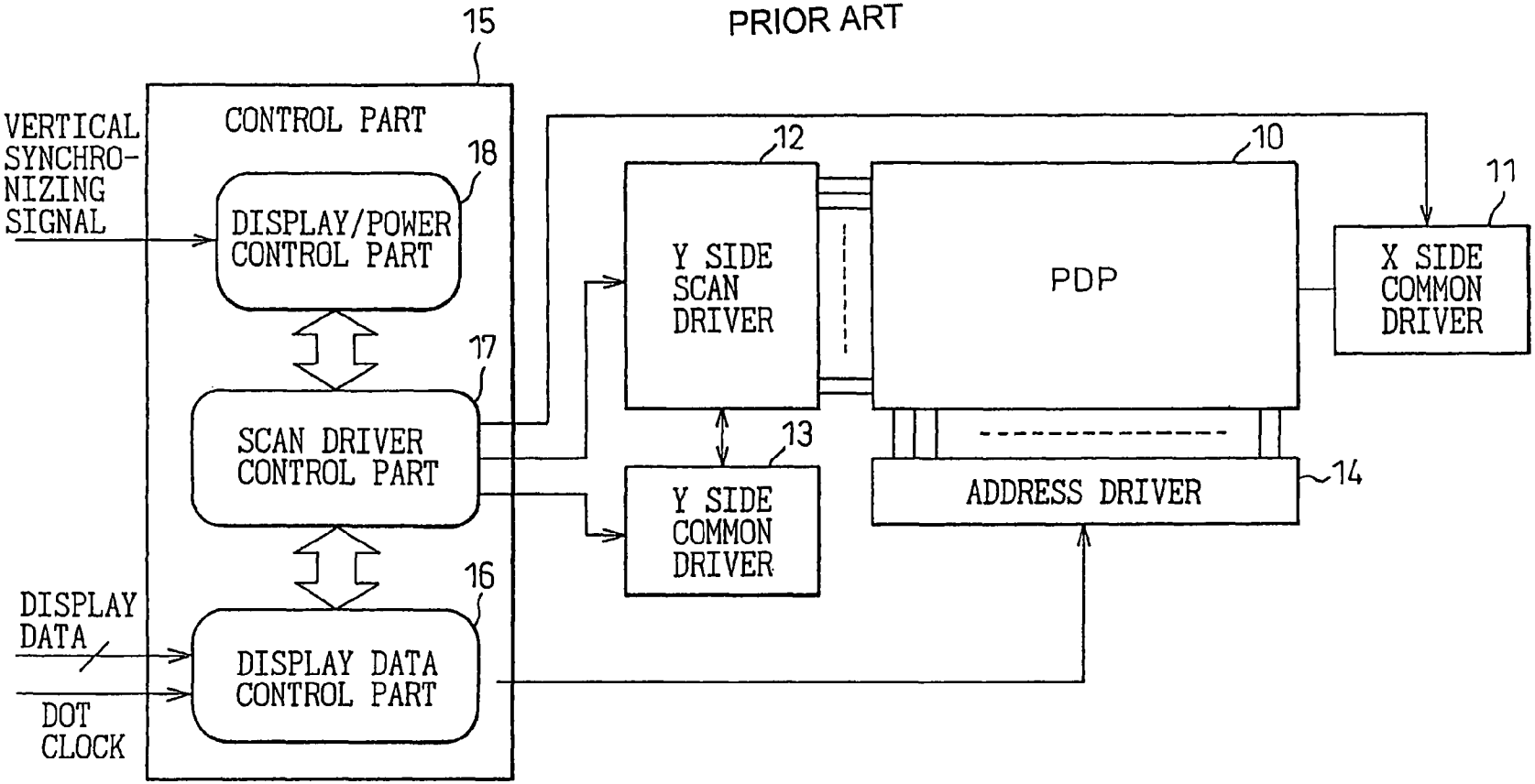
Fig.1 PRIOR ART
FIG. 1 is a block diagram the shows the general structure of the normal plasma display (PDP) apparatus.
Figure 2:
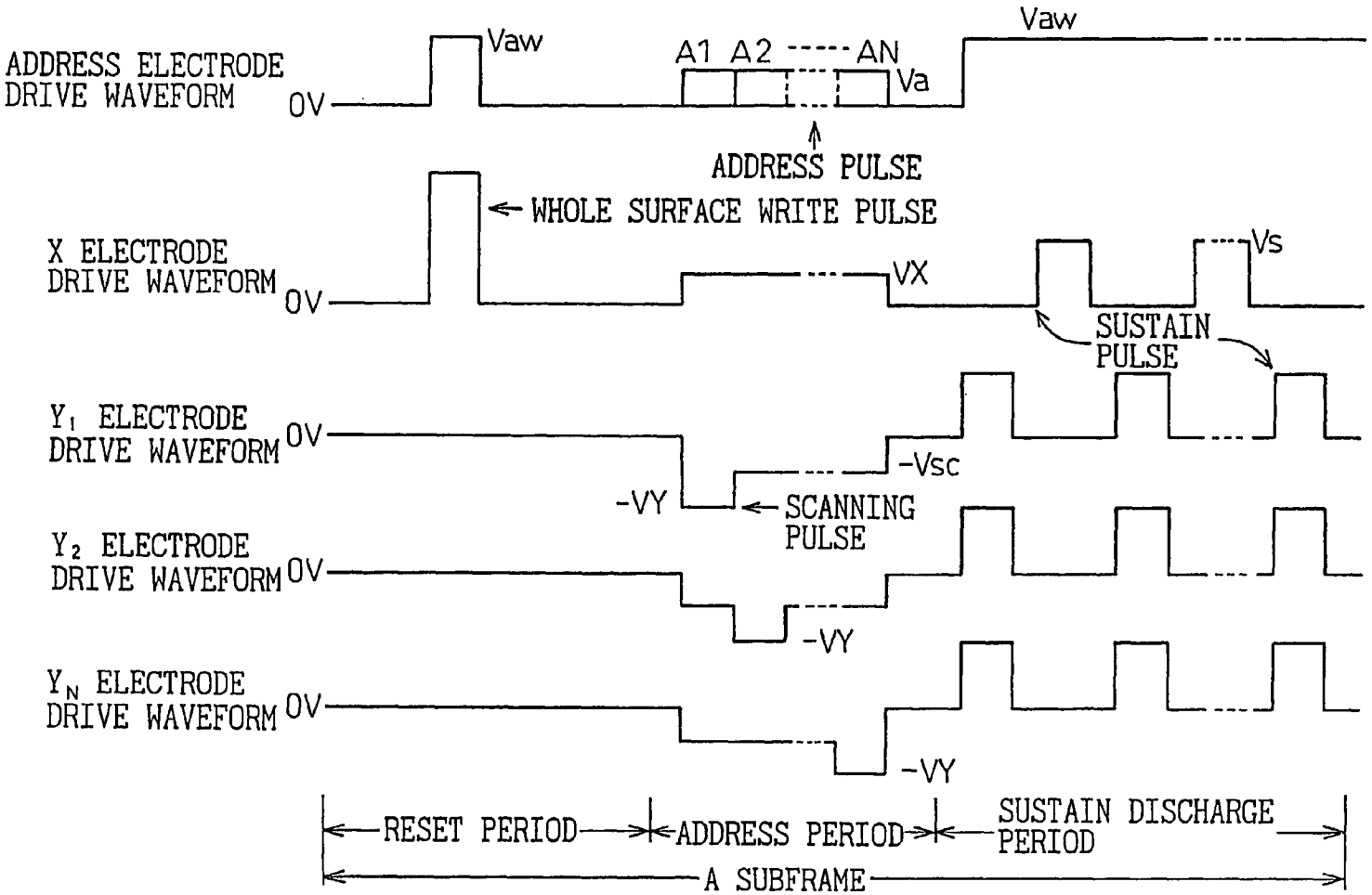
PRIOR ART Fig. 2
FIG. 2 is a time chart that shows the drive waveforms of the PDP apparatus.
Figure 7:
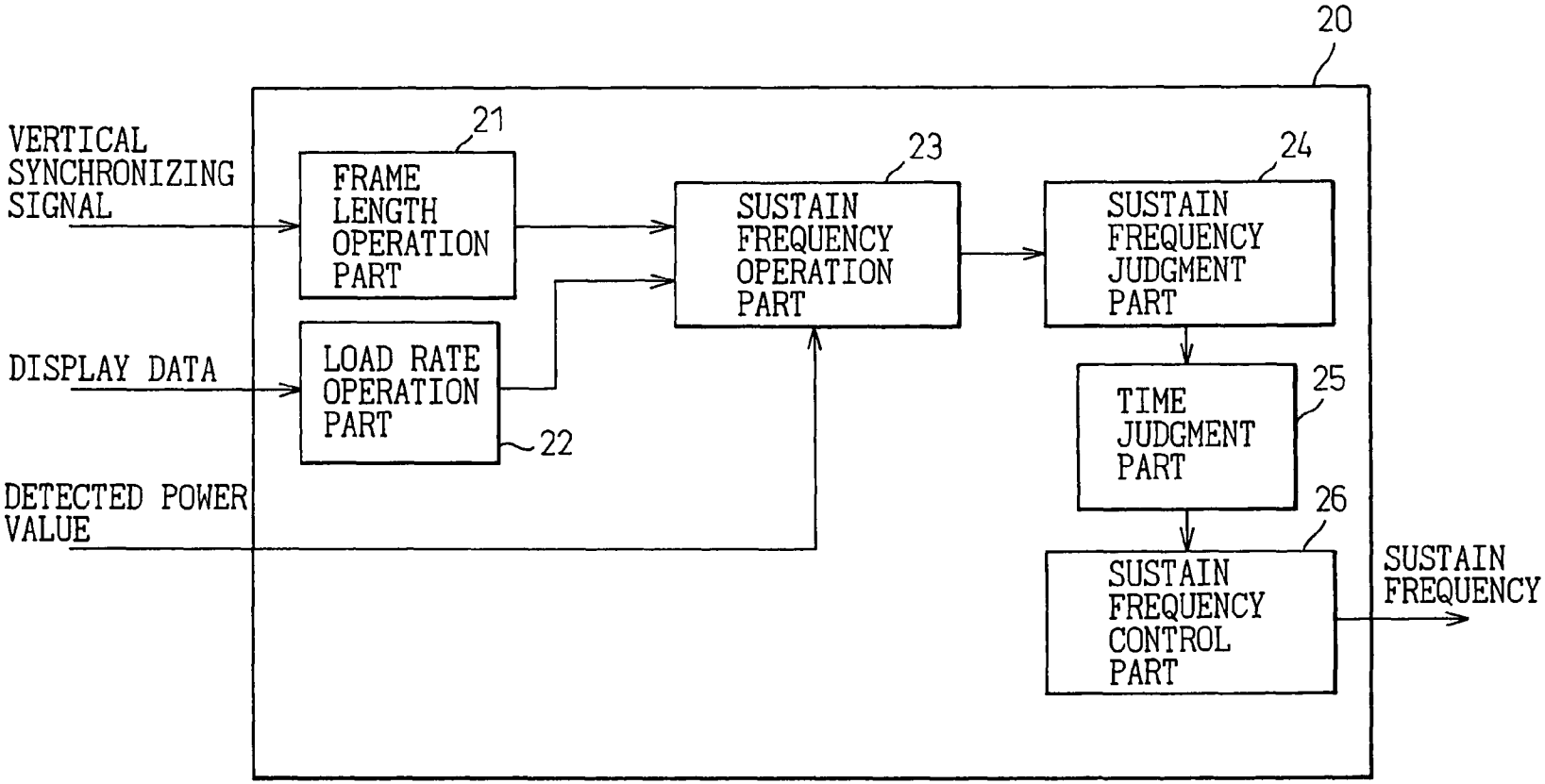
FIG. 7 is a diagram that shows the structure of the power control part in the PD apparatus in the first embodiment of the present invention.

FIG. 7 is a diagram that shows the structure of the power control part in the plasma display (PDP) apparatus in the first embodiment of the present invention. The PDP apparatus in the first embodiment has the structure as shown in FIG. 1, and the control part 15 has the power control part 20 as shown in FIG. 7. Other parts are identical to the conventional ones described above.

Figure 4:
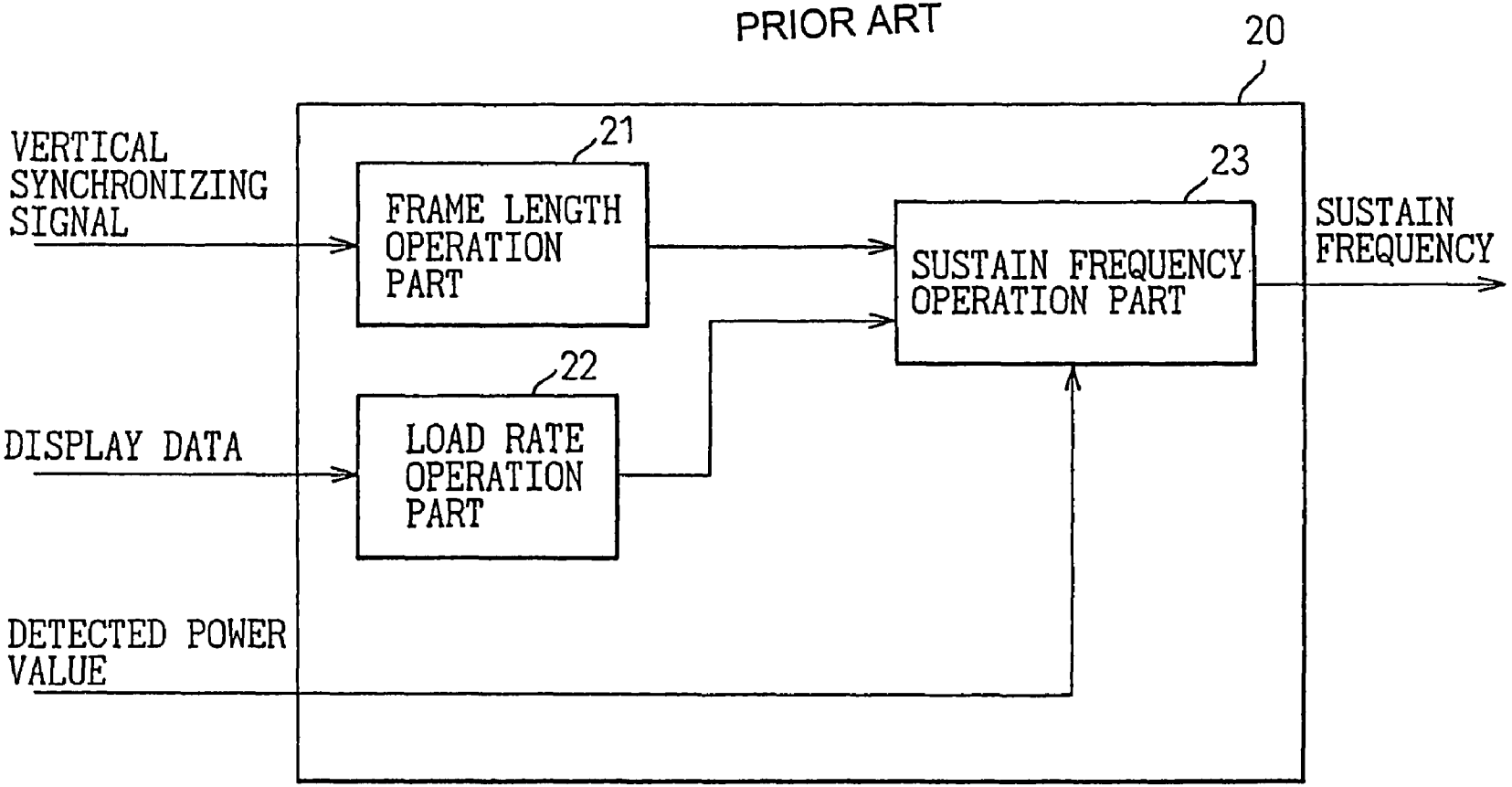
Fig. 4 PRIOR ART
FIG. 4 is a diagram that shows the structure of the conventional electrode control part.
Figures 5, 6:
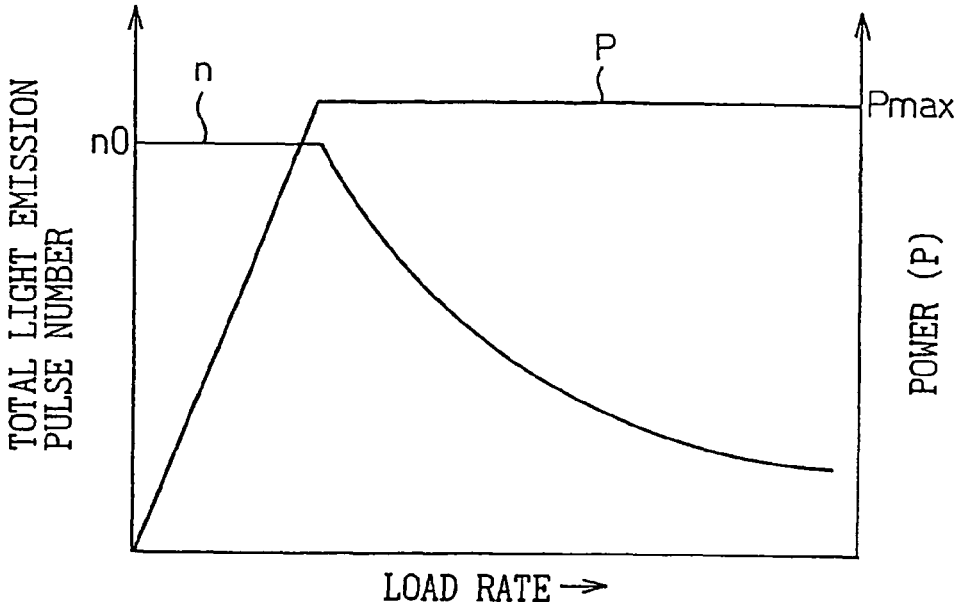
Fig.5 PRIOR ART
Fig.6 PRIOR ART
FIG. 5 is a graph that illustrates the conventional electrode control.
FIG. 6 is a diagram that illustrates the allocation of the number of sustaining pulses to each subframe when the total number of sustaining pulses changes.

As shown in FIG. 7, the power control part 20 comprises the frame length operation part 21, the load rate operation part 22, and the sustain frequency operation part 23, similarly as the conventional power control part in FIG. 4, and moreover, a sustain frequency judgment part 24, a time judgment part 25, and a sustain frequency control part 26. The sustain frequency judgment part 24, the time judgment part 25, and the sustain frequency control part 26 are realized by a CPU. With reference to the flow chart in FIG. 8, the control actions of these parts are described below.

In step S1, the sustain frequency judgment part 24 monitors the sustain frequency Fsus, which is calculated by a method similar to the conventional one, for each frame and compares it with the fixed threshold value Fth. This Fth is set in accordance with the object to prevent a thermal destruction or burning of the panel. Concretely, when a pattern with high contrast, in which an area with high brightness and an area with low brightness are contiguous to each other, is displayed, this threshold value Fth is set to a value so that thermal destruction and burning can be prevented from occurring if the cells are lit in the total light emission pulse number (sustain frequency) under the set Fth. When Fsus>Fth, that is, the sustain frequency is over the threshold value Fth, the flow advances to step S3, and when Fsus<Fth, that is, the sustain frequency is under the threshold value Fth, the flow advances to step S9.

In step S3, the time judgment part 25 increases the continuous Over time k and clears the continuous Under time m. Then, it is judged whether k is larger than the sustain period Tover or not in step S5, and when k is equal to or smaller than Tover, the flow is terminated until the subsequent frame with the sustain frequency Fsus is being maintained. When k is larger than Tover, the flow advances to step S7.

In step S7, the sustain frequency control part 26 decreases the sustain frequency Fsus by the constant $\alpha$ set arbitrarily. This decreases the sustain frequency Fsus. The constant $\alpha$ is set adequately according to the characteristics of the unit.

In step S9, the time judgment part 25 increases the continuous Under time m, and clears the continuous Over time k. Then, it is judged whether m is larger than the suppress period Tunder or not in step 11, and when m is equal to or smaller than Tunder, the flow is terminated until the subsequent frame with the sustain frequency Fsus is being maintained. When m is larger than Tunder, the flow advanced to step 13.

In step S13, the sustain frequency control part 26 increases the sustain frequency Fsus by the constant $\alpha$ set arbitrarily. This increases the sustain frequency Fsus. The constant $\alpha$ can be replaced with the different constant $\beta$, which is different from that in the case where the sustain frequency is decreased.

By the controls mentioned above, the sustain frequency is reduced to a allowable level when a high sustain frequency lasts a long time, an upward surge of the temperature is prevented and, as a result, thermal destruction and burning can be prevented.

Figure 9:
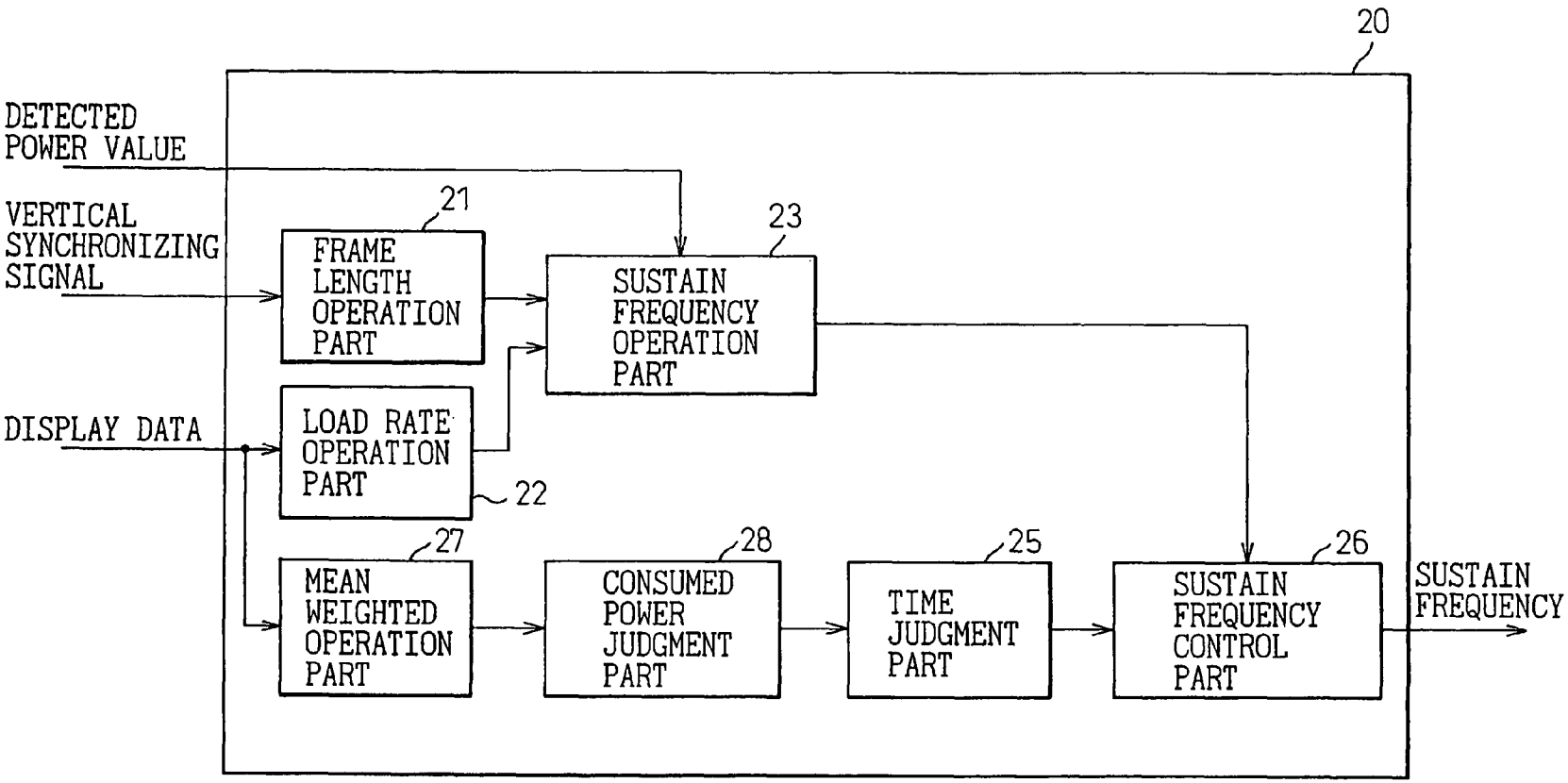
FIG. 9 is a diagram that shows the structure of the power control part in the PD apparatus in the second embodiment of the present invention.

FIG. 9 is a diagram that shows the structure of the power control part 20 in the PDP apparatus in the second embodiment of the present invention. As shown in FIG. 9, the power control part 20 in the second embodiment comprises the frame length operation part 21, the load rate operation part 22, and the sustain frequency operation part 23, similarly as the conventional power control part in FIG. 4, and moreover, a weighted mean operation part 27, a consumed power judgment part 28, the time judgment part 25, and the sustain frequency control part 26. The weighted mean operation part 27, the consumed power judgment part 28, the time judgment part 25, and the sustain frequency control part 26 are realized by a CPU. The control actions in the power control part 20 in the second embodiment are shown in the flow chart in FIG. 10

In the second embodiment, the weighted mean MW, instead of the sustain frequency, of the display data is monitored. In step S21, the weighted mean operation part 27 calculates the weighted mean for each frame. The weighted mean can be calculated from the display data converted for each subframe, and the consumed power can be estimated from this value. Concretely, the weighted mean can be obtained in a manner that the load rate of each subframe is weighted and the sum of those values is divided by the number of the subframes.

In step S23, the consumed power judgment part 28 compares the weighted mean threshold value MWth, which corresponds to the threshold power value, with the weighted mean MW of the display frame. The processing actions in step S23 are the same as those in step S1 in FIG. 8, and the subsequent actions also the same, except in that the weighted mean MW and the weighted mean threshold value MWth are used instead of the sustain frequency Fsus and the threshold value Fth.

Figure 11:
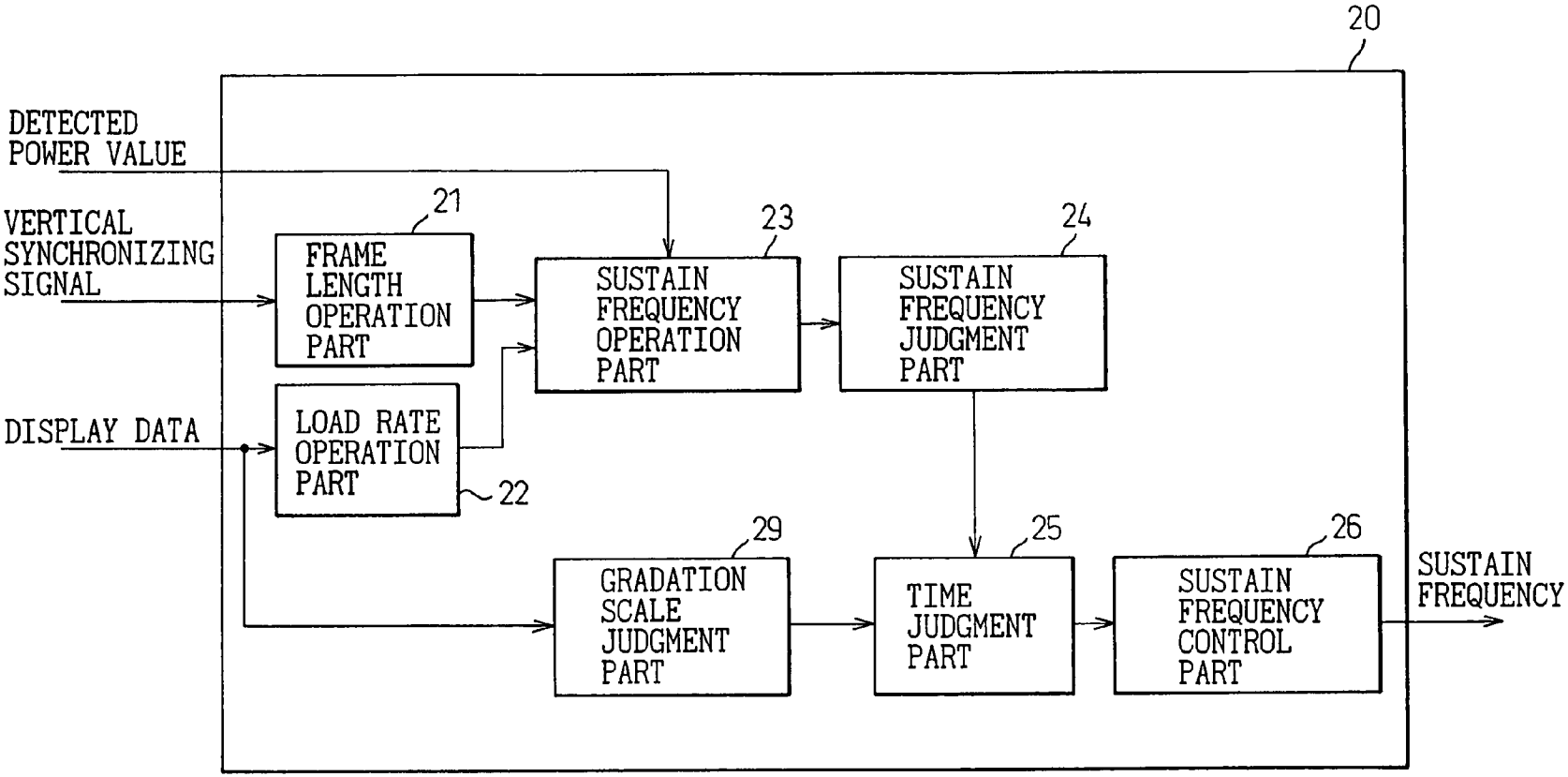
FIG. 11 is a diagram that shows the structure of the power control part in the PD apparatus in the third embodiment of the present invention.

FIG. 11 is a diagram that shows the structure of the power control part 20 in the PDP apparatus in the third embodiment of the present invention. As shown in FIG. 11, the power control part 20 in the third embodiment differs from that in the first embodiment in FIG. 7 in that a gradation scale judgment part 29 is provided in addition to the power control part in the first embodiment in FIG. 7. This gradation scale judgment part 29 is also realized by a CPU. The control actions in the power control part 20 in the third embodiment are shown in the flow chart in FIG. 12.

Figure 12:
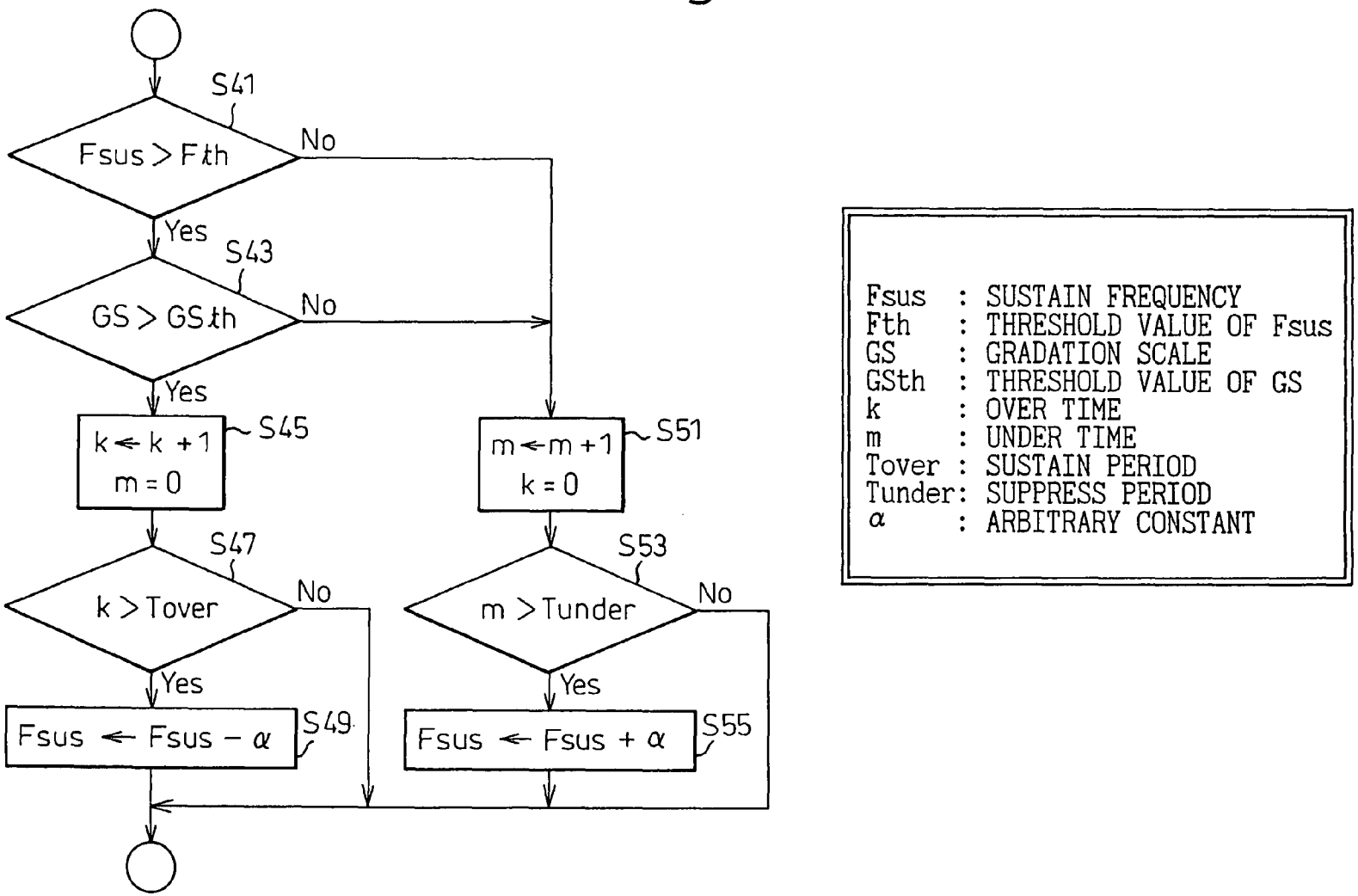
FIG. 12 is a flow chart that shows the power control action in the third embodiment.

As shown in FIG. 12, the control actions in the power control part 20 in the third embodiment differ from those in the first embodiment in that after step S41, in which it is judged whether the sustain frequency Fsus is over the threshold value Fth or not, step S43 is provided, in which it is judged whether the gradation scale GS is over the threshold value GSth or not, and the Over time is increased only when the sustain frequency Fsus is over the threshold value Fth and the gradation scale Gs is over the threshold value GSth, otherwise the Under time is increased. Step S43 is carried out by the gradation scale judgment part 29. In the processing actions in the first embodiment, whether the sustain frequency is large can be judged, but not how many percents are occupied by the light area. On the contrary, the Over time is increased only when the gradation scale GS is over the threshold value GSth in the third embodiment, therefore, the brightness is not lowered during dark display. The gradation scale GS can be calculated from the display data deployed for each subframe.

Figure 10:
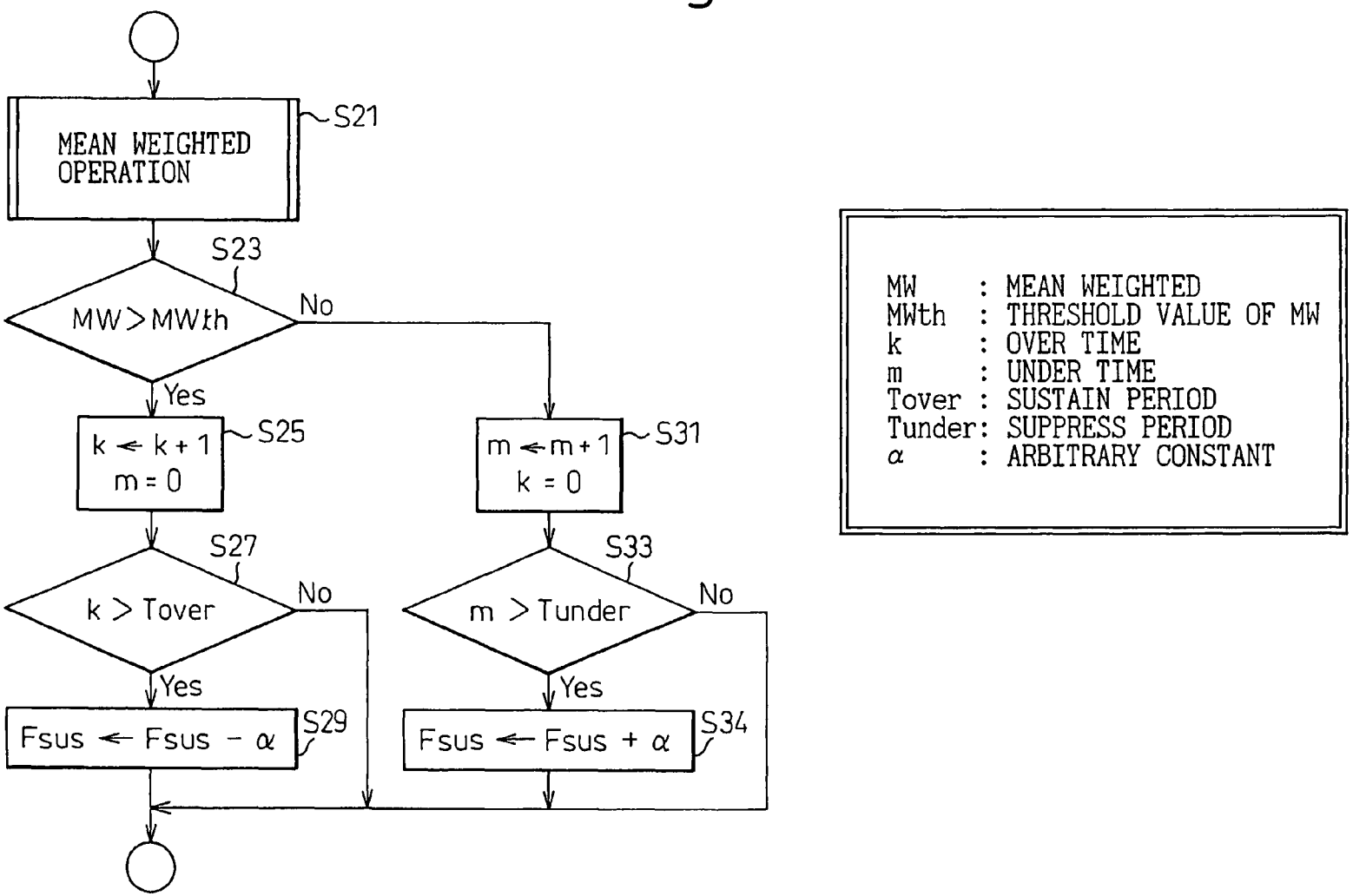
FIG. 10 is a flow chart that shows the power control action in the second embodiment.

Moreover, the structure to judge the gradation scale in the third embodiment can be applied in the second embodiment, and it is possible to design the structure so that the gradation scale judgment part is provided to the power control part in FIG. 9 and step S43 in FIG. 12 is provided after step S23 in the flow chart in FIG. 10.

In the embodiments from the first to the third, the sustain frequency is reduced when a state in which the sustain frequency or the weighted mean is over the threshold value lasts for a fixed period, and the sustain frequency is increased when a state in which those values are under the threshold value lasts for a fixed period, but this control does not function if the same pattern is repeated, or a state in which the sustain frequency or the weighted mean fluctuates beyond the threshold lasts. Thermal destruction and burning may be caused to occur when a pattern is displayed periodically, and in the above-mentioned embodiments, the sustain frequency is varied when such case is detected by the judgment of the cumulative time in the above-mentioned state.

Figure 13:
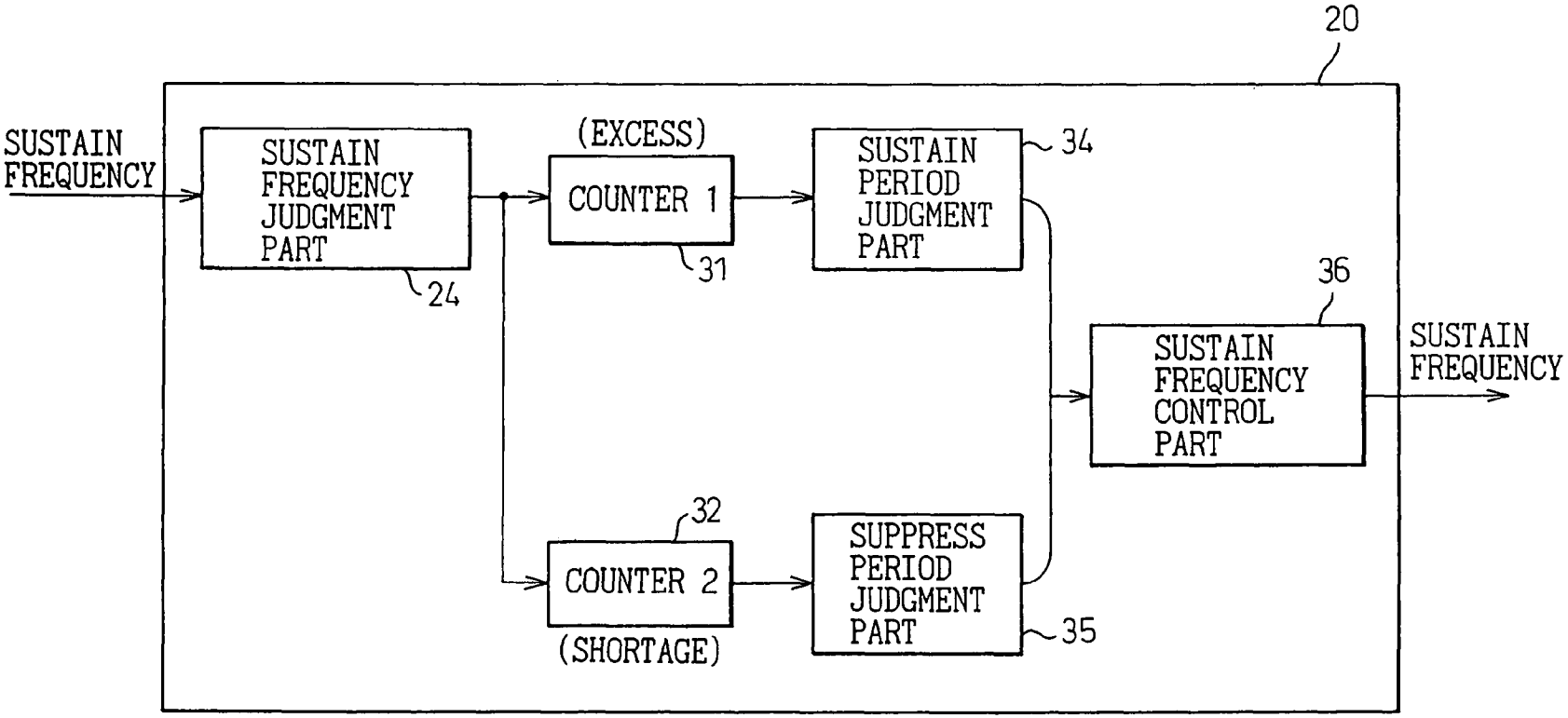
FIG. 13 is a diagram that shows the structure of the power control part in the PD apparatus in the fourth embodiment of the present invention.
Figure 14:
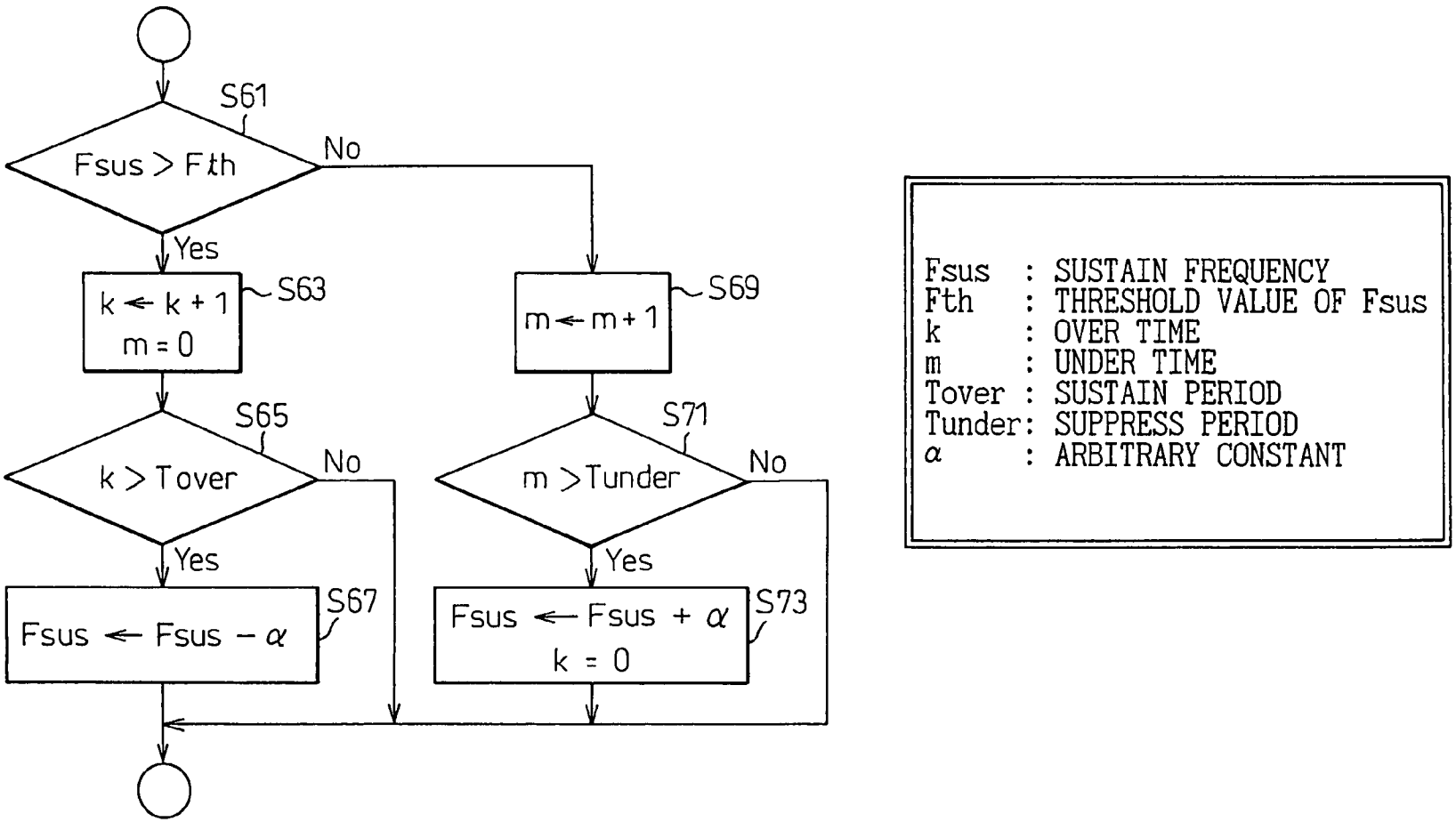
FIG. 14 is a flow chart that shows the power control action in the fourth embodiment.

FIG. 13 is a diagram that shows the structure of the power control part in the PDP apparatus in the fourth embodiment of the present invention. The frame length operation part 21, the load rate operation part 22, and the sustain frequency operation part 23 are omitted here. As shown in FIG. 13, the power control part 20 in the fourth embodiment comprises the sustain frequency judgment part 24, a first counter 31, a second counter 32, a sustain period judgment part 34, a suppress period judgment part 35 and a sustain frequency control part 36, in addition to the conventional power control part the second in FIG. 4. These parts are also realized by a CPU. With reference to the flow chart in FIG. 14, the control actions in these parts are described below.

In the fourth embodiment, the sustain frequency judgment part 24 carries out step S61, and similarly, the first counter 31, step S63, the second counter 32, step S69, the sustain period judgment part 34, step S65, the suppress period judgment part 35, step S71, and the sustain frequency control part 36 carries out steps S67 and S73.

Figure 8:
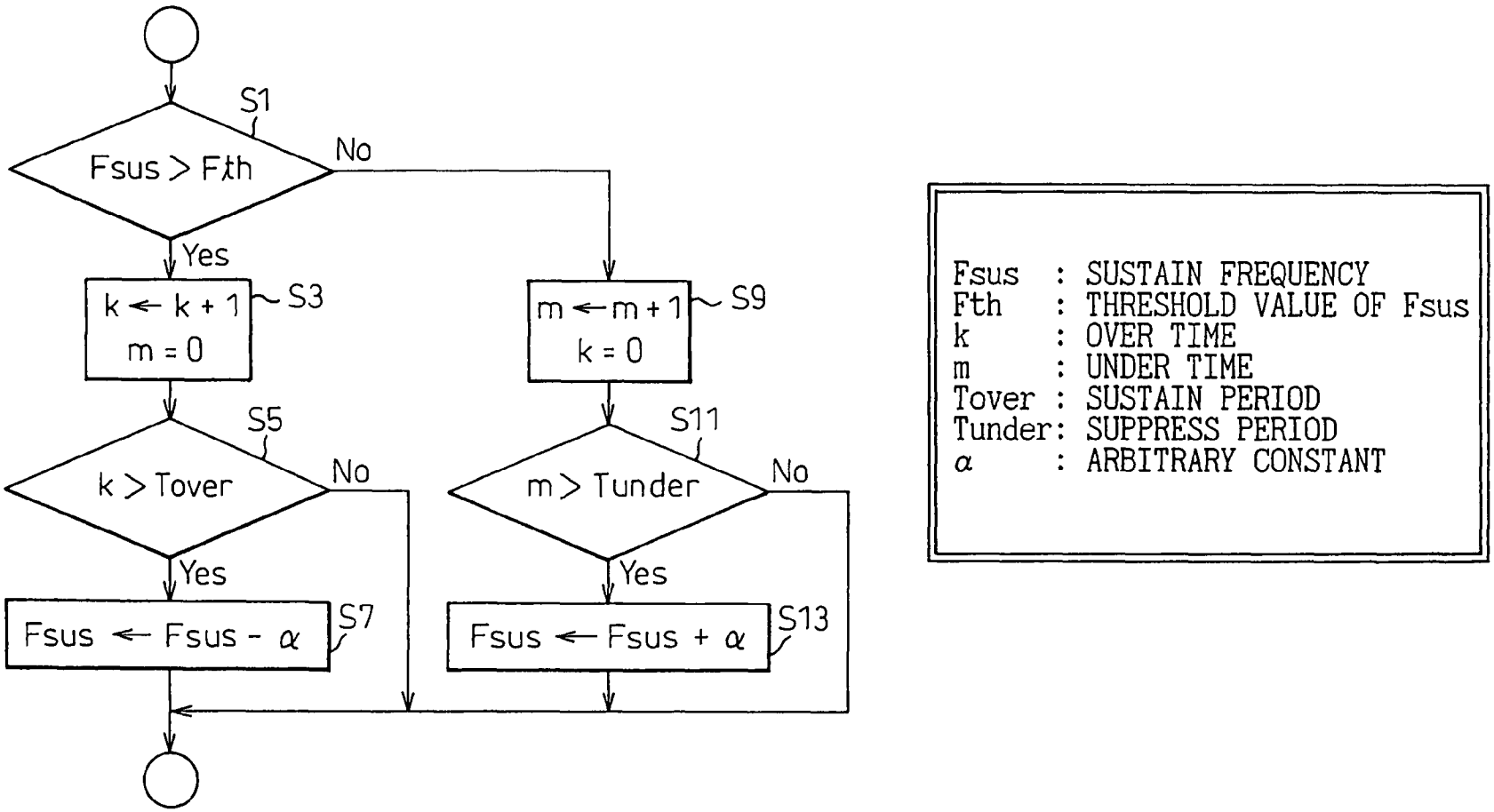
FIG. 8 is a flow chart that shows the power control action in the first embodiment.

Compared to the flow chart in FIG. 8, the control actions in the fourth embodiment differ in that when the continuous Under time m is increased in step S69 the continuous Over time k is not cleared, and when the sustain frequency Fsus is increased in step S73 the continuous Over time k is cleared. In the control actions in the fourth embodiment, the continuous Over time k is not cleared even if the sustain frequency Fsus becomes temporarily lower than the threshold value Fth, but the continuous Under time m is cleared when the sustain frequency Fsus becomes over the threshold value Fth, even if temporarily. By this, the judgment whether the sustain frequency Fsus becomes periodically over the threshold value Fth is prioritized and when such a state occurs frequently though periodically, the sustain frequency Fsus is reduced to prevent the thermal destruction and burning. On the contrary, the sustain frequency Fsus is increased only when the sustain frequency Fsus becomes under the threshold value Fth constantly.

Figure 3:
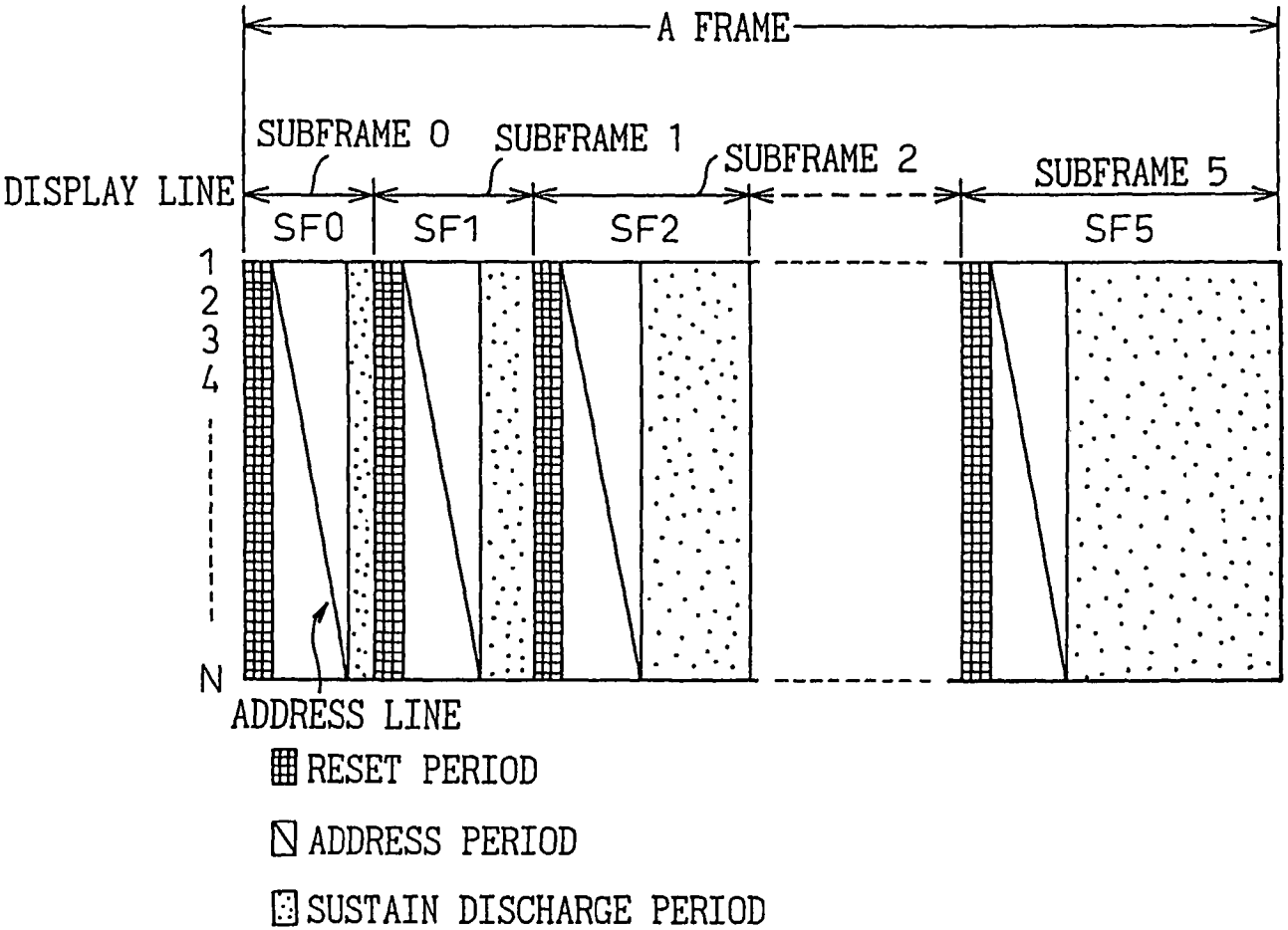
Fig. 3 PRIOR ART
FIG. 3 is a time chart of the address/sustain discharge separated type address method to attain the gradation display in the PDP.
Figure 15:
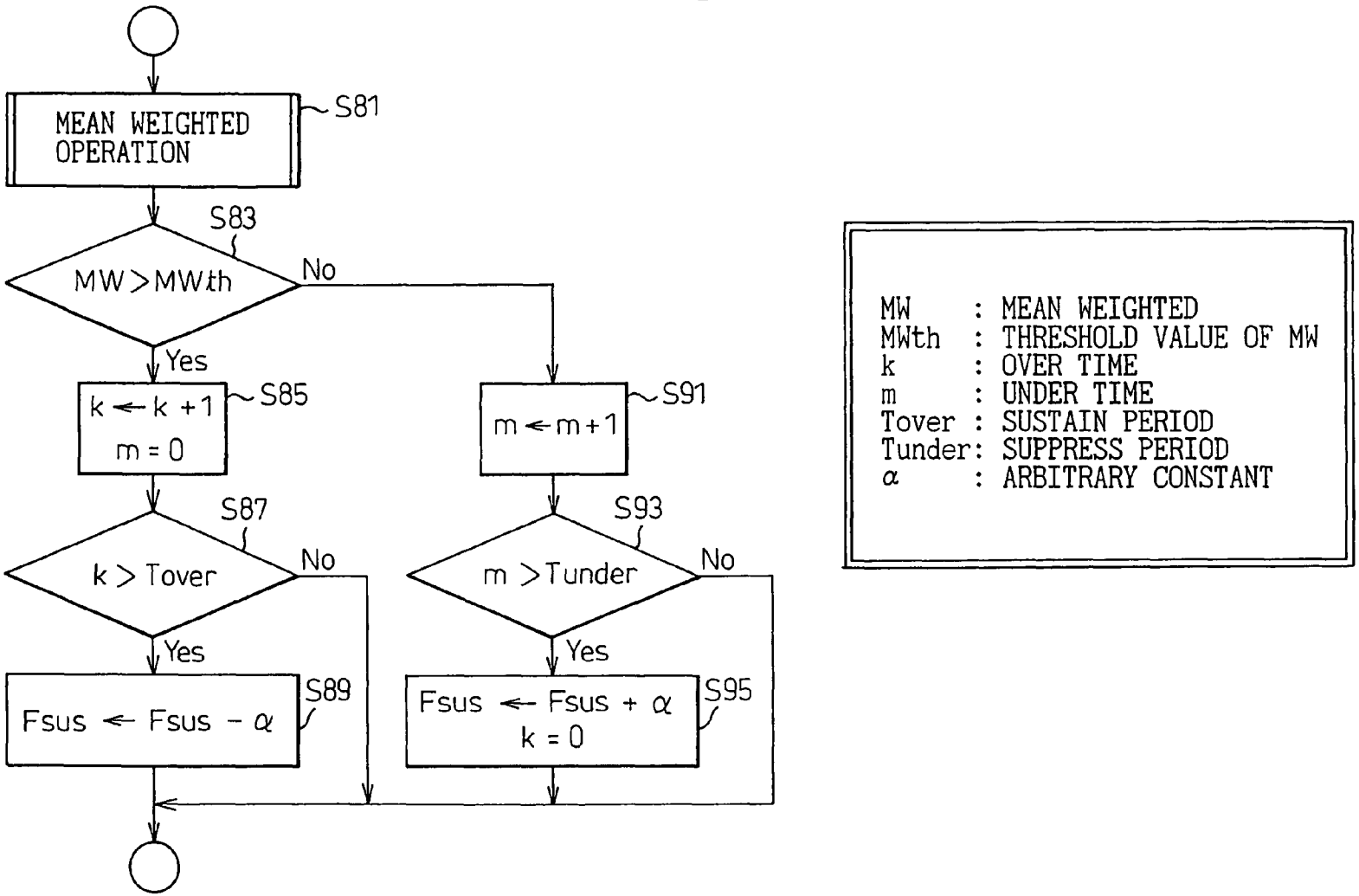
FIG. 15 is a flow chart that shows the power control action in the fifth embodiment of the present invention.

FIG. 15 is a flow chart that shows the control actions in the power control part in the PDP apparatus in the fifth embodiment of the present invention. In addition to the structure in the fourth embodiment in FIG. 3, the weighted mean operation part and the consumed power judgment part in FIG. 9 are provided in the power control part in the fifth embodiment.

The control actions in the fifth embodiment differs from those in the fourth embodiment in that the weighted mean MW, instead of the sustain frequency, of the display data is monitored. By this control, the sustain frequency is increased or reduced so that the consumed power becomes within the threshold power even when a display of such as a repeated pattern lasts.

Figure 16:
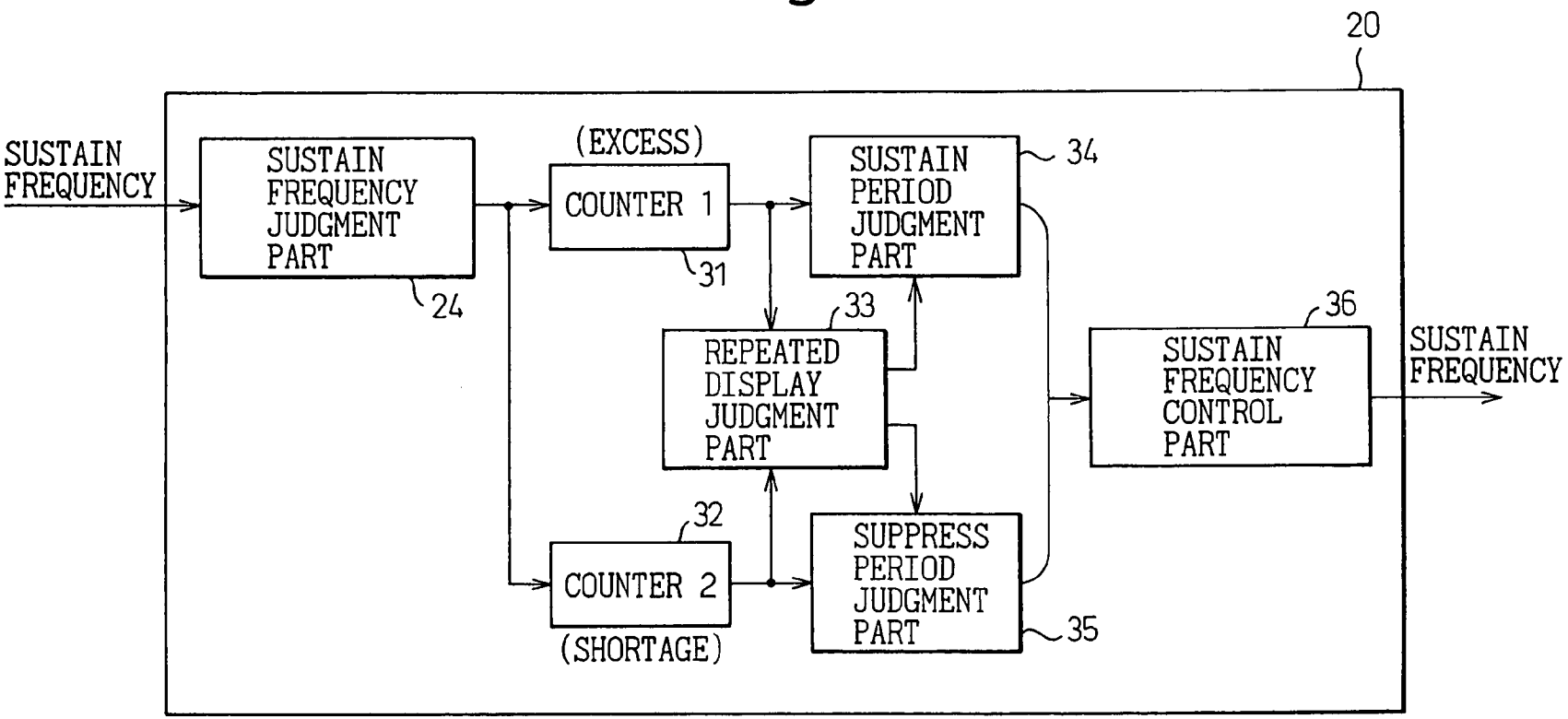
FIG. 16 is a diagram that shows the structure of the power control part in the PDP apparatus in the sixth embodiment of the present invention.
Figure 17:
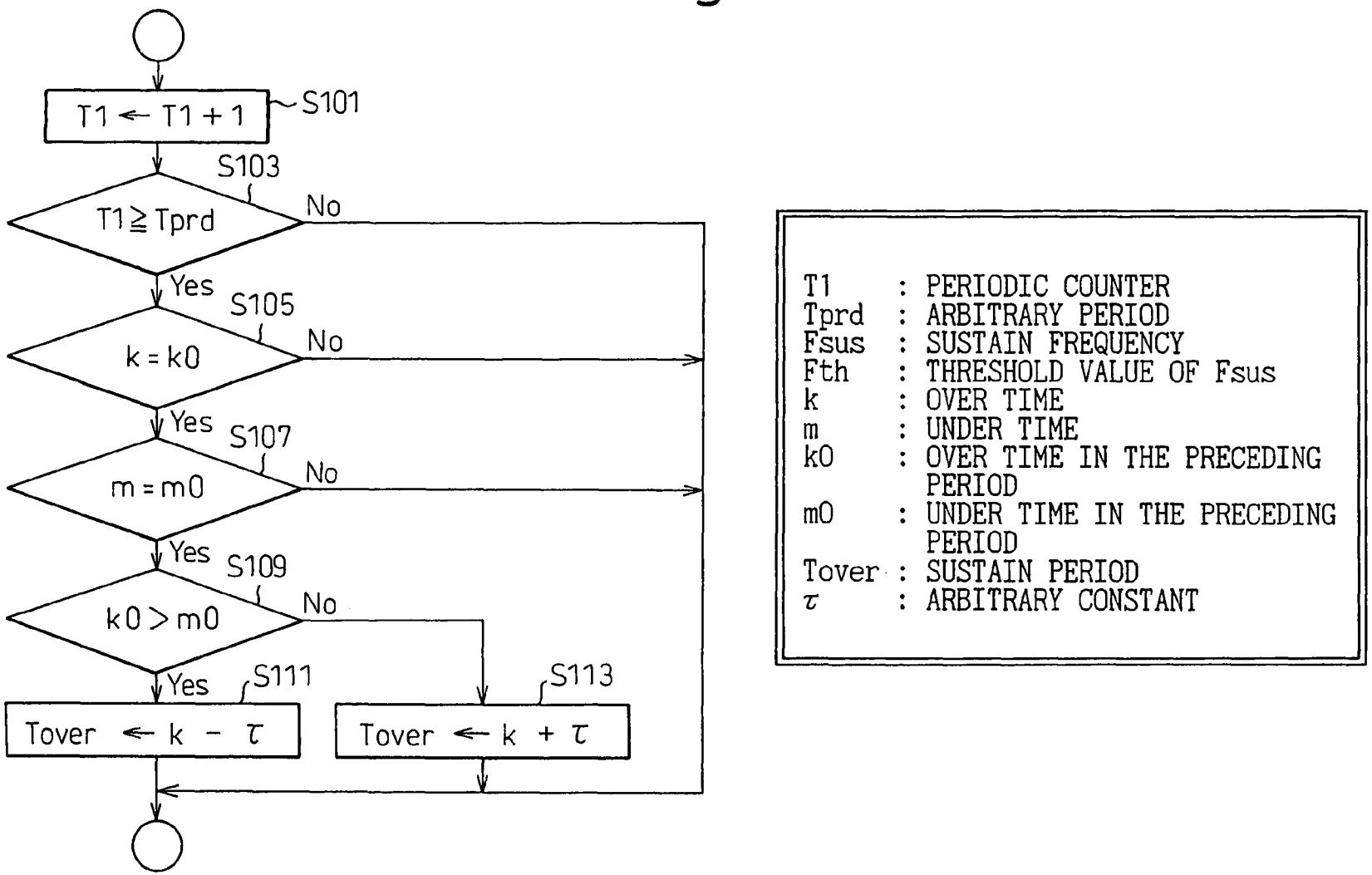
FIG. 17 is a flow chart that shows the power control action in the sixth embodiment.

FIG. 16 is a diagram that shows the structure of the power control part in the PDP apparatus in the sixth embodiment of the present invention, and a repeated display judgment part 33 is provided in addition to the structure of the power control part in the fourth embodiment in FIG. 13. FIG. 17 is a flow chart that shows the control actions in the repeated display judgment part 33.

When a repeated pattern is displayed with a certain period, it is possible to control the sustain frequency more properly according to the display pattern by making the sustain period Tover and the suppress period Tunder variable according to the period. Therefore, in such a case, a time in which loads are concentrated and that in which loads are not concentrated, are detected with an arbitrary period, and the continuous Over time k and the continuous Under time m are increased or reduced based on the comparison of the length of those times. More concretely, when the time k0 in which loads are concentrated is longer than the time m0 in which not concentrated, the sustain period is shortened to reduce the sustain frequency as early as possible. On the contrary, when k0 is shorter than m0, the sustain period is lengthened so that a state with high brightness lasts as long as possible. Such control actions are carried out in the sixth embodiment.

The periodic counter T1 is increased in step S101, whether T1 exceeds an arbitrary period Tprd is judged in step S103, and when Tprd is exceeded the flow advances to step S105 and when not, advancement is held in abeyance until the subsequent frame. Whether the Over time k is equal to the Over time k0 in the preceding period is judged in step S105, and when they are equal, the flow advances to step S107, and when not, advancement is held in abeyance until the subsequent frame. Whether the Under time m is equal to the Under time m0 in the preceding period is judged in step S107 and when they are equal, the flow advances to step S109, and when not, advancement is held in abeyance until the subsequent frame. The lengths of the Over time k0 and the Under time m0 are compared in step S109, and when k0>m0, the sustain period is reduced in step S111, and when k0<m0, the sustain period is increased in step S113.

In the fourth to sixth embodiments, the operation time from the power turn-on of the PDP apparatus is not taken into account, but it is more efficient to make the sustain period and the suppress period variable according to the operation time to maintain high brightness because there is actually a considerable difference in the averaged panel temperature between at the operation start time and after a fixed elapsed time. In the seventh embodiment, the control actions are realized to carry out the above-mentioned method.

Figure 18:
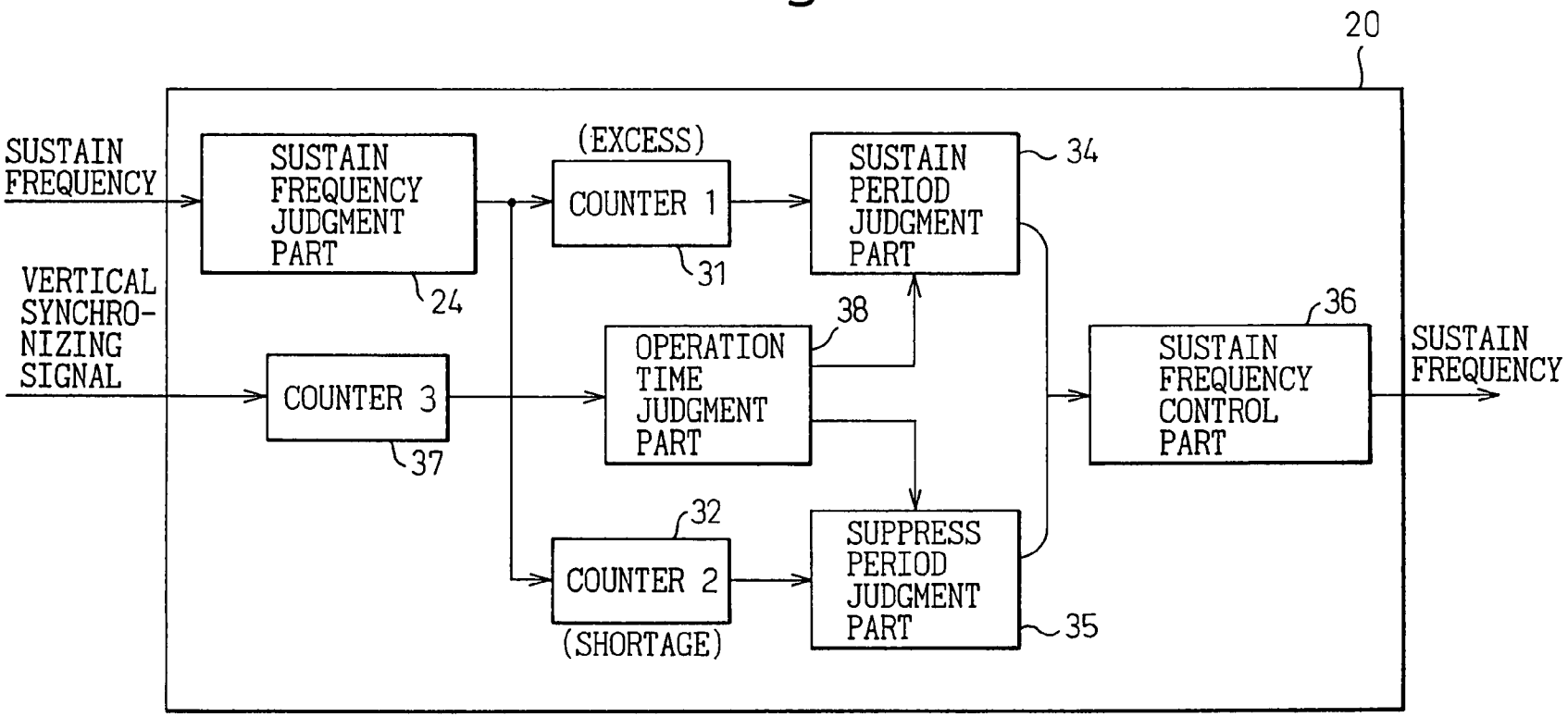
FIG. 18 is a diagram that shows the structure of the power control part in the PDP apparatus in the seventh embodiment of the present invention.
Figure 19:
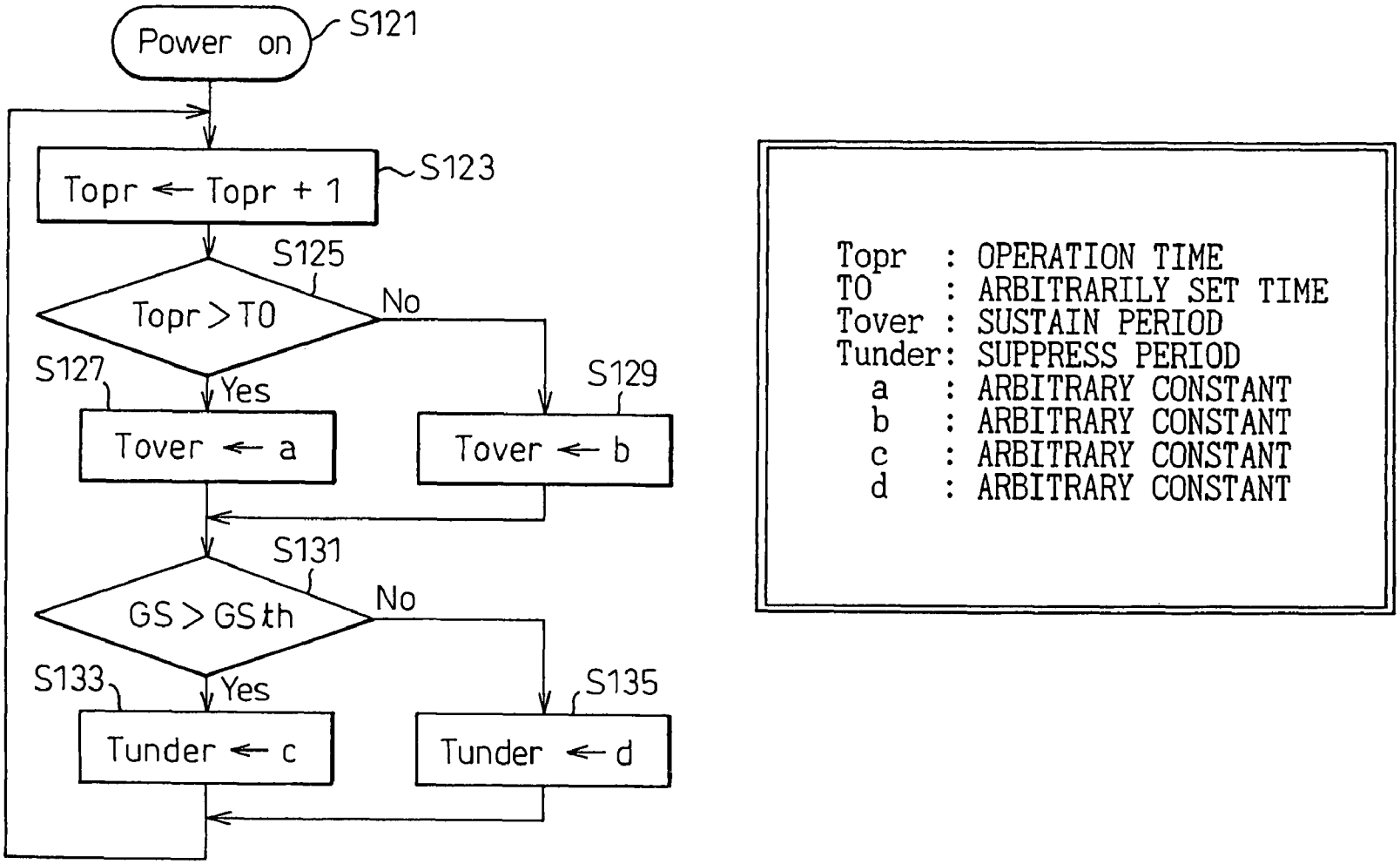
FIG. 19 is a flow chart that shows the power control action in the seventh embodiment.

FIG. 18 is a diagram that shows the structure of the power control part in the PDP apparatus in the seventh embodiment of the present invention, to which a third counter 37 and an operation time judgment part 38 are added in addition to the structure of the power control part in the fourth embodiment in FIG. 13. FIG. 19 is a flow chart that shows the control actions of the third counter 37 and the operation time judgment part 38.

The power is turned on in step S121, and the operation time Topr is counted in step S123. In step S125, whether the operation time Topr exceeds an arbitrarily set time T0 is judged, and if so, the flow advances to step S127 and a relatively smaller value a is set to the sustain period Tover to shorten it, and if not exceeded, the flow advances to step S129 and a relatively larger value b is set to the sustain period Tover to lengthen it. Similarly, in steps S131 to S135, if the gradation scale GS exceeds the threshold value GSth, a relatively smaller c is set to the suppress period Tunder to shorten it, and if it is not exceeded, a relatively larger value d is set to the suppress period Tunder to lengthen it. The lengths of the sustain period and the suppress period are varied according to the operation time and the gradation scale here, and it is acceptable to vary the suppress period according to the display rate or brightness because they change depending on the amount of heat and the heat radiation conditions.

In some PD apparatus, a cooling fan is provided to cool the panel. The cooling fan is operated or the operation conditions (e.g. accelerated rotation/decelerated rotation) are changed according to the circumstances. Therefore, it is possible to suppress the increase in temperature of the panel efficiently by operating or accelerating the cooling fan during the period in which the sustain frequency is high and terminating or decelerating the cooling fan during the suppress period. In the eighth embodiment, the control of the cooling fan is carried out.

Figure 20:
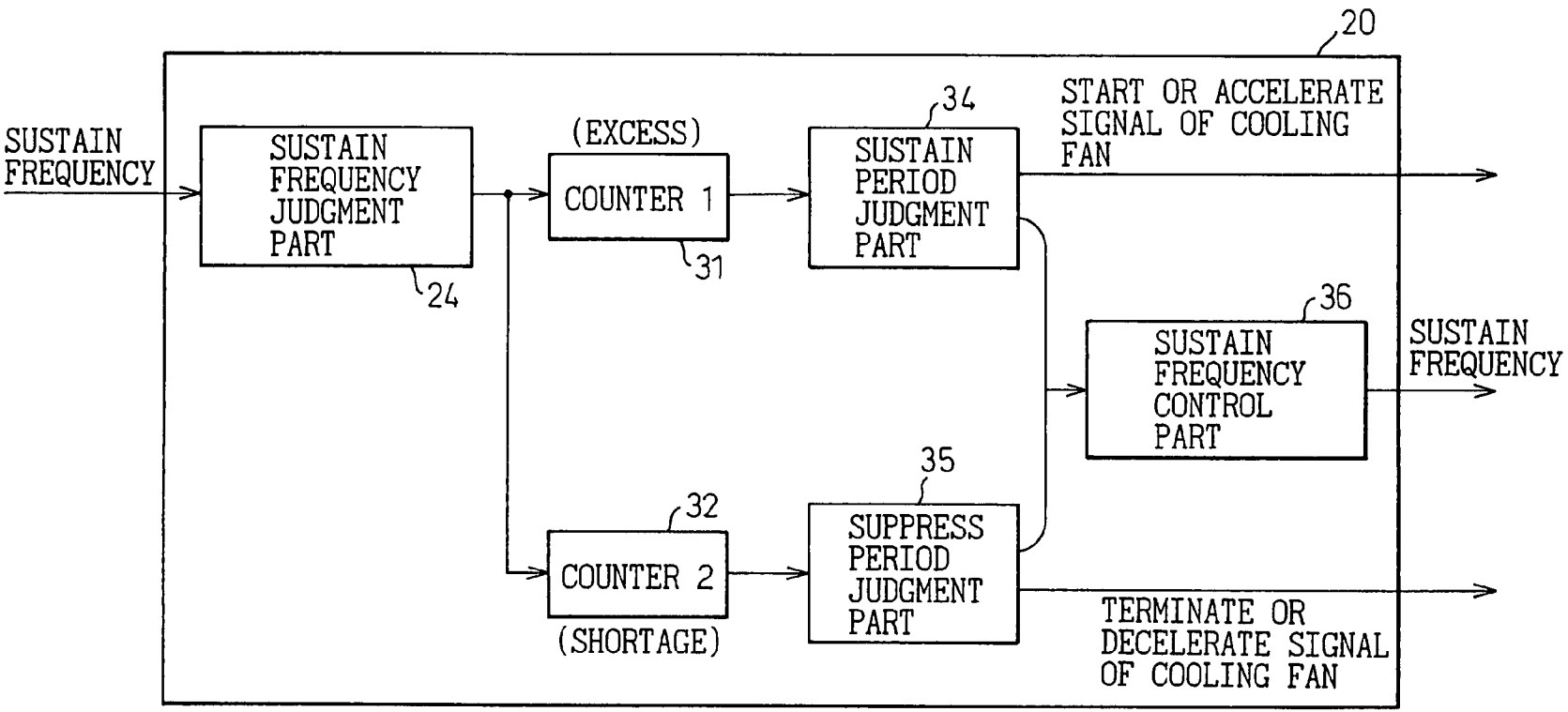
FIG. 20 is a diagram that shows the structure of the power control part in the PDP apparatus in the eighth embodiment of the present invention.
Figure 21:
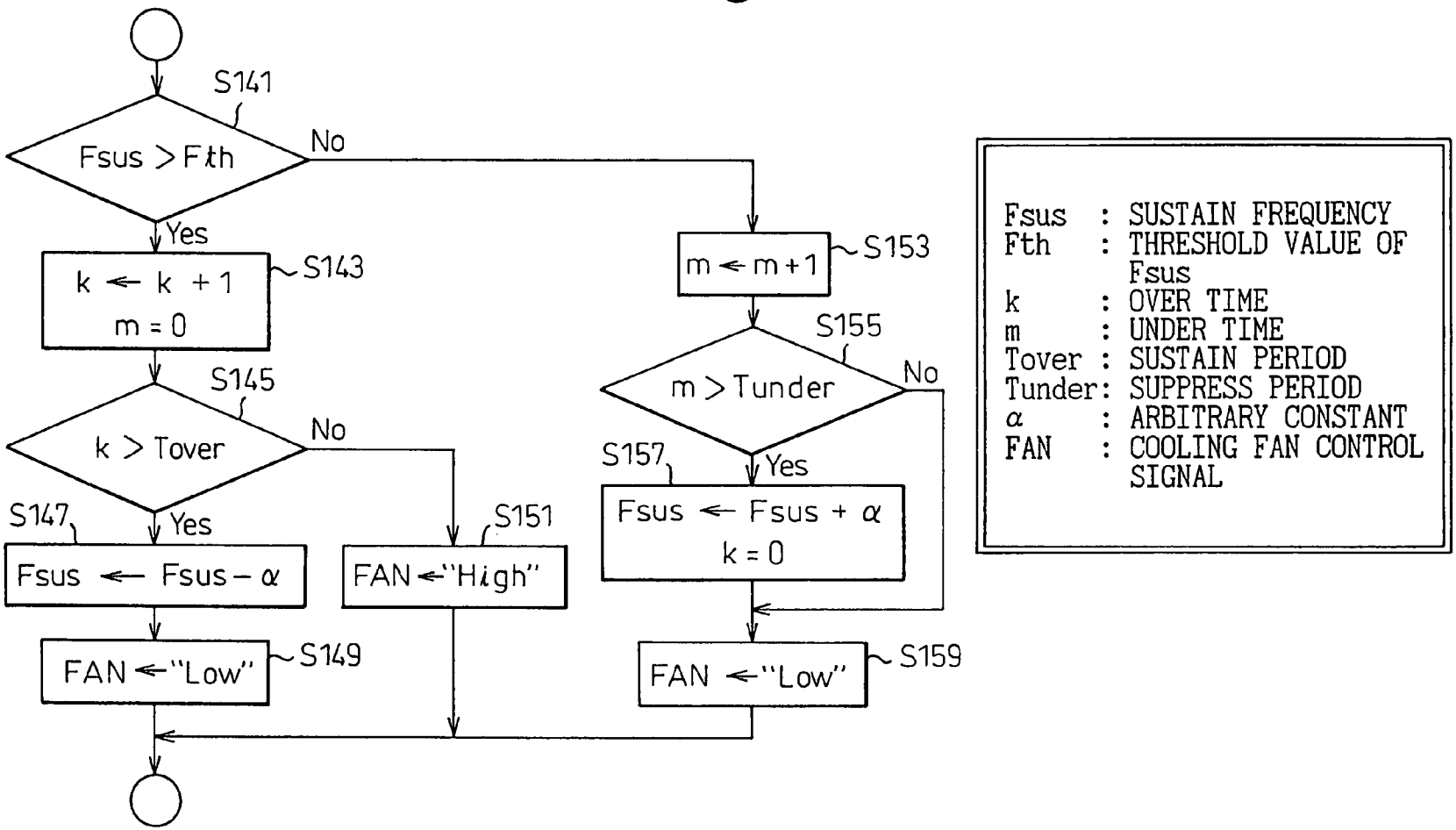
FIG. 21 is a flow chart that shows the power control action in the eighth embodiment.

FIG. 20 is a diagram that shows the structure of the power control part in the PDP apparatus in the eighth embodiment of the present invention, and the structure differs from that in the fourth embodiment in FIG. 13 in that the sustain period judgment part 34 issues the start or accelerate signal of the cooling fan, and the suppress period judgment part 35 issues the terminate or decelerate signal of the cooling fan. FIG. 21 is a flow chart that shows the control actions in the power control part in the eighth embodiment.

If compared to the flow chart in the fourth embodiment in FIG. 4, this flow chart differs in that steps S149, S151, and S159 are added. After the sustain frequency Fsuc is reduced in step S147, the cooling fan is decelerated in step S147. When it is judged that the continuous Over time k is shorter than the sustain period Tover in step S145, the cooling fan is accelerated in step S151. Moreover, after the sustain frequency Fsus is increased in step S157, the cooling fan is decelerated in step S159.

The embodiments of the present invention are described as above, but the present invention is not restricted to these embodiments, and there can be various modifications. For example, a modification can be realized in which characteristic parts in each embodiment are combined, or the characteristic parts, which are added to the structure in the first embodiment and realized in the third embodiment through the eighth embodiment, can be combined to that in the second embodiment.

As described above, according to the present invention, thermal destruction of the panel and burning of the screen caused by the display pattern can be prevented by employing a simple structure.

The invention claimed is:

1. A display apparatus having plural cells in which light emission is carried out selectively, display brightness is determined by a number of times of said light emission and a total number of times of light emission in each cell of a display frame of a screen is varied according to a load rate of display data, said display apparatus comprising:

a sustain frequency judgment part judging whether a first state, in which said total number of times of light emission is over a fixed threshold value, lasts substantially more than a predetermined period which is no longer than or equal to a period of plural frames by monitoring a number of times of light emission; and a control part decreasing said total number of times of light emission when said first state lasts substantially more than said predetermined period.

2. The display apparatus as set forth in claim 1, wherein:

said sustain frequency judgment part judges whether a second state, in which said total number of times of light emission is under said fixed threshold value, lasts more than a predetermined suppress period; and said control part increases said total number of times of light emission when said second state lasts more than said predetermined period.

3. The display apparatus as set forth in claim 1, wherein, by counting the operation time of the display apparatus from a time of power turn-on, said sustain frequency judgment part varies said predetermined period.

4. The display apparatus as set forth in claim 2, wherein, by counting the operation time of the display apparatus from a time of power turn-on, said sustain frequency judgment part varies said predetermined period.

5. The display apparatus as set forth in claim 2, further comprising:

a cooling fan controlled, based on the judgment results of said sustain frequency judgment part.

6. The display apparatus as set forth in claim 5, wherein said cooling fan is started or accelerated when said sustain frequency judgment part judges that said first state lasts substantially more than said predetermined period, and is terminated or decelerated when said sustain frequency judgment part judges that said second state lasts more than said predetermined period.

7. A display apparatus having plural cells in which light emission is carried out selectively, display brightness is determined by a number of times of said light emission, and a total number of times of light emission in each cell of a display frame of a screen is varied according to a load rate of display data, said display apparatus comprising:

a judgment part judging whether a first state, in which said total number of times of light emission is over a fixed threshold value and a gradation scale, calculated from the display data, is over a fixed gradation threshold value, lasts substantially more than a predetermined period which is longer than or equal to a period of plural frames; and a control part decreasing said total number of times of light emission when said first state lasts substantially more than said predetermined period.

8. The display apparatus as set forth in claim 7, wherein:

said judgment part judges whether a second state, in which said total number of times of light emission is under said fixed threshold value or said gradation scale is under said fixed gradation value, lasts more than a predetermined period; and said control part increases said total number of times of light emission when said second state lasts more than said predetermined period.

* * * * *